US007735561B2

(12) United States Patent
Johnson et al.

(10) Patent No.: US 7,735,561 B2
(45) Date of Patent: Jun. 15, 2010

(54) SUBSEA ADAPTER FOR CONNECTING A RISER TO A SUBSEA TREE

(75) Inventors: Mark Alan Johnson, Houston, TX (US); Dana Earl Witt, Katy, TX (US); James David Dowell, Sugarland, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 144 days.

(21) Appl. No.: 12/036,392

(22) Filed: Feb. 25, 2008

(65) Prior Publication Data

US 2009/0050329 A1 Feb. 26, 2009

Related U.S. Application Data

(60) Provisional application No. 60/892,483, filed on Mar. 1, 2007.

(51) Int. Cl.
*E21B 7/12* (2006.01)
*E21B 29/12* (2006.01)

(52) U.S. Cl. ..... 166/339; 166/367; 166/356; 166/368

(58) Field of Classification Search ..... 166/368, 166/345, 356, 365, 338, 339, 367; 251/1.1
See application file for complete search history.

(56) References Cited

U.S. PATENT DOCUMENTS 2,684,575 A * 7/1954 Pryor et al. ..... 166/358
2,713,909 A * 7/1955 Baker ..... 166/70
2,965,174 A * 12/1960 Haeber ..... 175/8
2,988,144 A * 6/1961 Conrad ..... 166/352
3,527,294 A * 9/1970 Courtright, Jr. et al. ..... 166/356
3,603,409 A * 9/1971 Watkins ..... 175/7
3,968,656 A * 7/1976 Kalinowski ..... 405/193

(Continued)

FOREIGN PATENT DOCUMENTS

DE 2056064 * 2/1977

(Continued)

OTHER PUBLICATIONS

PCT International Search Report and Written Opinion, International App. No. PCT/US2008/054865, Jul. 11, 2008.

(Continued)

*Primary Examiner*—Thomas A Beach
(74) *Attorney, Agent, or Firm*—Nicholas F. Gallo

(57) ABSTRACT

A method and system for performing intervention and workover operations on a subsea well are provided, as well as an adapter for connecting a lower end portion of a conduit extending from a vessel with an upper portion of a lower marine riser package associated with a subsea tree. The method includes providing a lower marine riser package connected to an upper portion of a subsea tree associated with a subsea well, and a conduit extending from a vessel toward the lower marine riser package. The conduit is connected to the lower marine riser package with an adapter. A portion of a conduit bore of the conduit above the adapter is sealed from a chamber in the adapter, and a portion of a bore extending through the lower marine riser package is sealed from the chamber. The adapter is opened for access to the chamber from the sea.

14 Claims, 5 Drawing Sheets

U.S. PATENT DOCUMENTS

| | | | | | |
|---|---|---|---|---|---|
| 4,043,407 | A | * | 8/1977 | Wilkins | 175/50 |
| 4,153,113 | A | * | 5/1979 | Hopkins et al. | 166/356 |
| 4,192,384 | A | * | 3/1980 | Croy | 166/356 |
| 4,201,074 | A | * | 5/1980 | Cox | 72/168 |
| 4,456,062 | A | * | 6/1984 | Roche et al. | 166/84.4 |
| 4,456,063 | A | * | 6/1984 | Roche | 166/84.4 |
| 4,617,998 | A | * | 10/1986 | Langner | 166/345 |
| 4,646,844 | A | * | 3/1987 | Roche et al. | 166/379 |
| 4,702,320 | A | * | 10/1987 | Gano et al. | 166/343 |
| 5,098,219 | A | * | 3/1992 | Harrington et al. | 405/8 |
| 6,015,013 | A | | 1/2000 | Edwards et al. | |
| 6,039,122 | A | * | 3/2000 | Gonzalez | 166/379 |
| 6,138,774 | A | * | 10/2000 | Bourgoyne et al. | 175/7 |
| 6,182,765 | B1 | * | 2/2001 | Kilgore | 166/381 |
| 6,457,526 | B1 | * | 10/2002 | Dailey | 166/338 |
| 6,675,888 | B2 | * | 1/2004 | Schempf et al. | 166/65.1 |
| 6,814,140 | B2 | * | 11/2004 | Robichaux | 166/77.4 |
| 7,036,598 | B2 | * | 5/2006 | Skjaerseth et al. | 166/339 |
| 7,165,619 | B2 | * | 1/2007 | Fox et al. | 166/343 |
| 7,331,394 | B2 | * | 2/2008 | Edwards et al. | 166/339 |
| 7,578,349 | B2 | * | 8/2009 | Sundararajan et al. | 166/363 |
| 2003/0178200 | A1 | * | 9/2003 | Fox et al. | 166/341 |
| 2004/0238177 | A1 | * | 12/2004 | Fossli | 166/364 |
| 2006/0124314 | A1 | * | 6/2006 | Haheim et al. | 166/368 |
| 2007/0196180 | A1 | * | 8/2007 | Haughom | 405/195.1 |
| 2008/0093082 | A1 | * | 4/2008 | Sheshtawy | 166/368 |
| 2008/0271922 | A1 | * | 11/2008 | Haughom | 175/10 |

FOREIGN PATENT DOCUMENTS

| | | | | |
|---|---|---|---|---|
| WO | WO 2004018826 | A1 | * | 3/2004 |
| WO | WO 2007004887 | A1 | * | 1/2007 |
| WO | WO 2007129899 | A1 | * | 11/2007 |
| WO | WO 2008100149 | | * | 8/2008 |
| WO | WO 2008130242 | | * | 10/2008 |

OTHER PUBLICATIONS

Haheim, et. al., Assembly and Method for Intervention of a Subsea Well, Jun. 15, 2006, 1-19.

* cited by examiner

SUBSEA ADAPTER FOR CONNECTING A RISER TO A SUBSEA TREE

CROSS-REFERENCE TO RELATED APPLICATIONS

This application claims the benefit of U.S. Provisional Application No. 60/892,483, filed Mar. 1, 2007.

BACKGROUND OF THE INVENTION

1. Field of the Invention

This invention relates in general to an adapter that is utilized between a riser and a subsea tree, and in particular to an adapter for use with a string of casing used as a riser through which coiled tubing, wireline, and jointed pipe can be lowered into the subsea well for intervention and workover operations.

2. Description of Related Art

Intervention and workover operations performed on subsea wells can be costly and time-consuming. For example, in one conventional subsea well, a down hole intervention system is provided for performing such operations. The down hole intervention system is provided separately from a drilling system used in the well. While such systems can be effective for performing necessary intervention and workover operations, the use of a separate system for such intervention and workover operations requires advance scheduling of the intervention system, and requires a changeover operation, and/or requires a separate rig.

According, there exists a continued need for improved systems and methods for performing workover operations.

SUMMARY OF THE INVENTION

The embodiments of the present invention generally provide a method and system for performing intervention and workover operations on a subsea well. According to one embodiment, the method includes providing a lower marine riser package connected to an upper portion of a subsea tree associated with a subsea well, and a conduit extending from a vessel toward the lower marine riser package; connecting the conduit to the lower marine riser package with an adapter; sealing a portion of a conduit bore of the conduit above the adapter from a chamber in the adapter; sealing a portion of a bore extending through the lower marine riser package from the chamber; and opening the adapter for access to the chamber from the sea.

According to another embodiment, the system includes a conduit extending from a vessel toward a subsea tree associated with a subsea well; a lower marine riser package connected to an upper portion of the subsea tree, the lower marine riser package having a package bore in communication with a tree bore extending through the subsea tree and a well bore extending though the subsea well, the lower marine riser package selectively sealing the package bore; an adapter connected to a lower end portion of the conduit and an upper portion of the lower marine riser package, the adapter having a chamber and an opening through a sidewall that is selectively opened and closed; an upper valve that selectively seals a portion of a conduit bore of the conduit above the adapter from the chamber; and a lower valve that selectively seals a portion of the package bore below the chamber.

There is also provided an adapter for connecting a lower end portion of a conduit extending from a vessel with an upper portion of a lower marine riser package associated with a subsea tree. The adapter can include a chamber and an opening through a sidewall that is selectively opened and closed; an upper valve that selectively seals the chamber from a portion of a conduit bore of the conduit above the chamber; and a lower valve that selectively seals the chamber from a portion of the lower marine riser package bore below the chamber.

DETAILED DESCRIPTION OF THE PREFERRED EMBODIMENT

Figure 1:
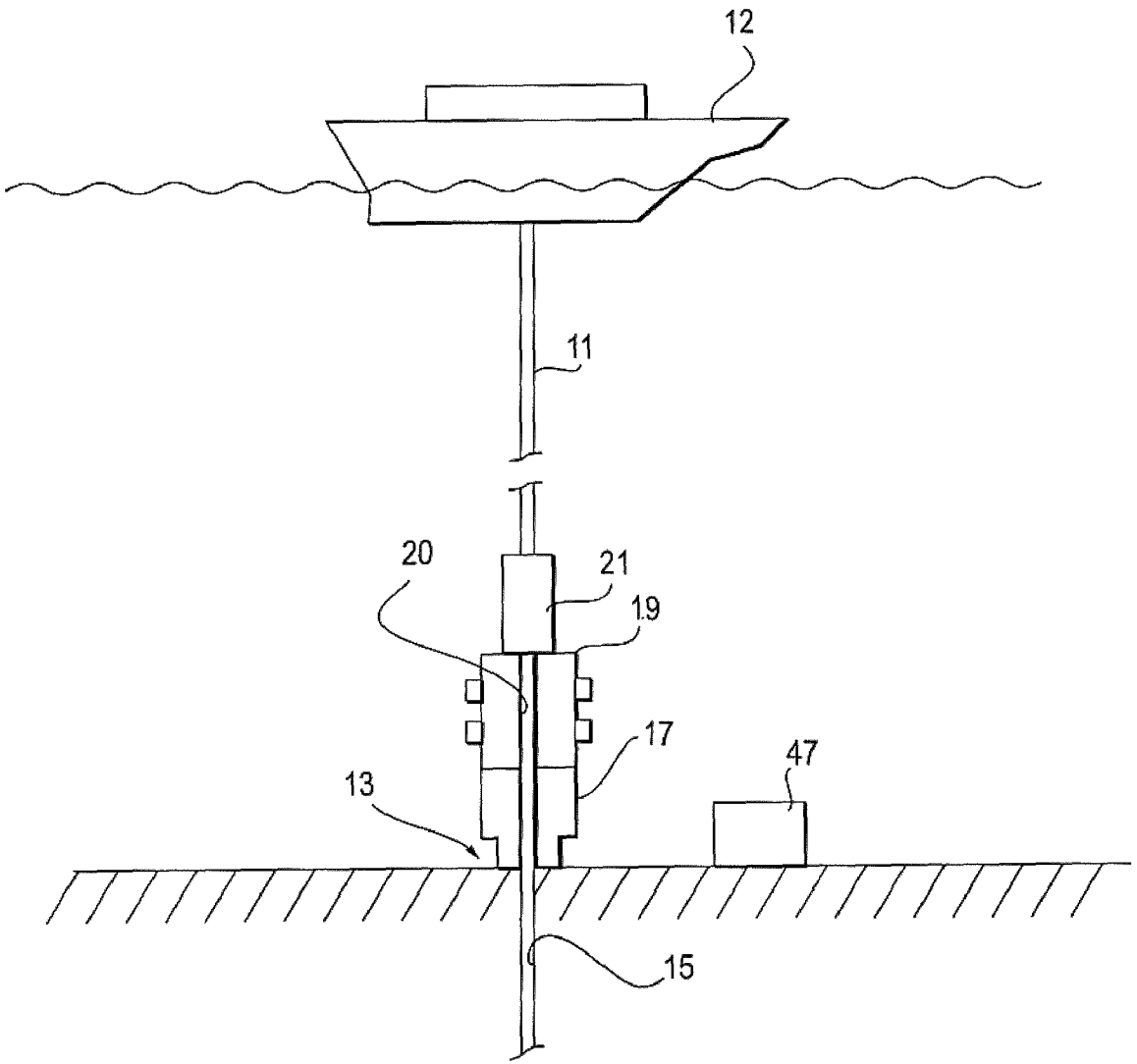
FIG. 1 is a schematic view of a riser and an adapter connecting to a subsea well assembly constructed and being installed in accordance with this invention.

Referring to FIG. 1, a riser 11 extends from a vessel 12 at the surface of the sea to a subsea well 13 at the sea floor. In the preferred embodiment, riser 11 is a string of standard casing, typically having an inner diameter of 7⅝ inches. It will be readily apparent to those skilled in the art that the diameter of the casing can be varied as desired, to typically coincide with the inner diameter of a bore 15 of subsea well 13.

Subsea well 13 includes a subsea tree 17 that has been landed upon and connected a high pressure wellhead. Subsea tree 17 can be a conventional horizontal or vertical production tree. A lower marine riser package (LMRP) 19 is positioned above subsea tree 17 for performing intervention and maintenance on subsea tree 17 and subsea well 13. As will be readily appreciated by those skilled in the art, LMRP 19 can include rams, shears and a blow out preventer (BOP), as desired. LMRP 19 preferably has a bore 20 that aligns with bore 15 of subsea well. The use of the term "LMRP" should not be construed to only providing for rams, shears, and/or not including a BOP. An adapter 21 is connected to a lower end portion of riser 11 for connecting riser 11 to LMRP 19.

Figure 2:
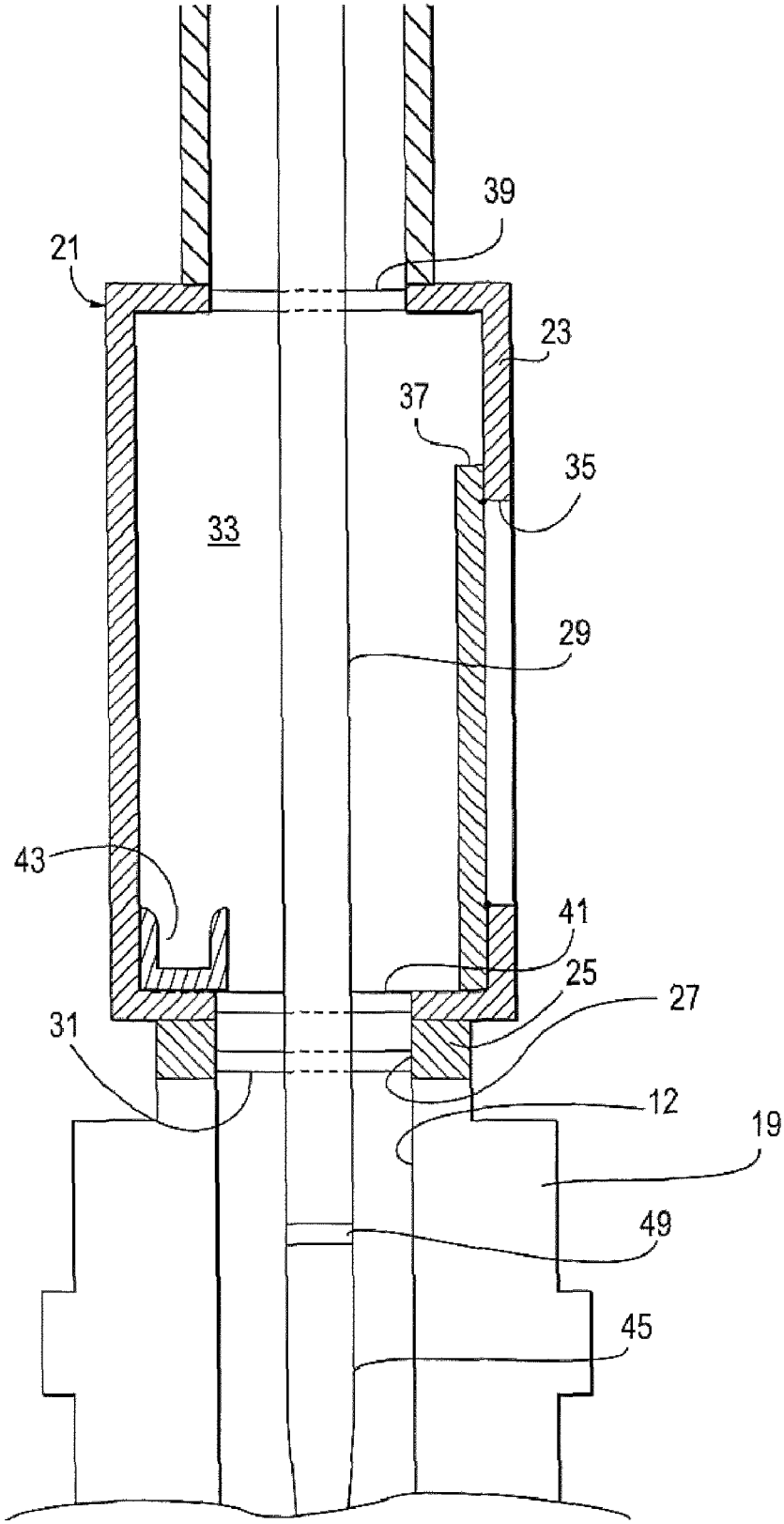
FIG. 2 is an enlarged schematic sectional view of the adapter FIG. 1 connecting the riser and subsea well, with the adapter being sealed from the sea.
Figure 3:
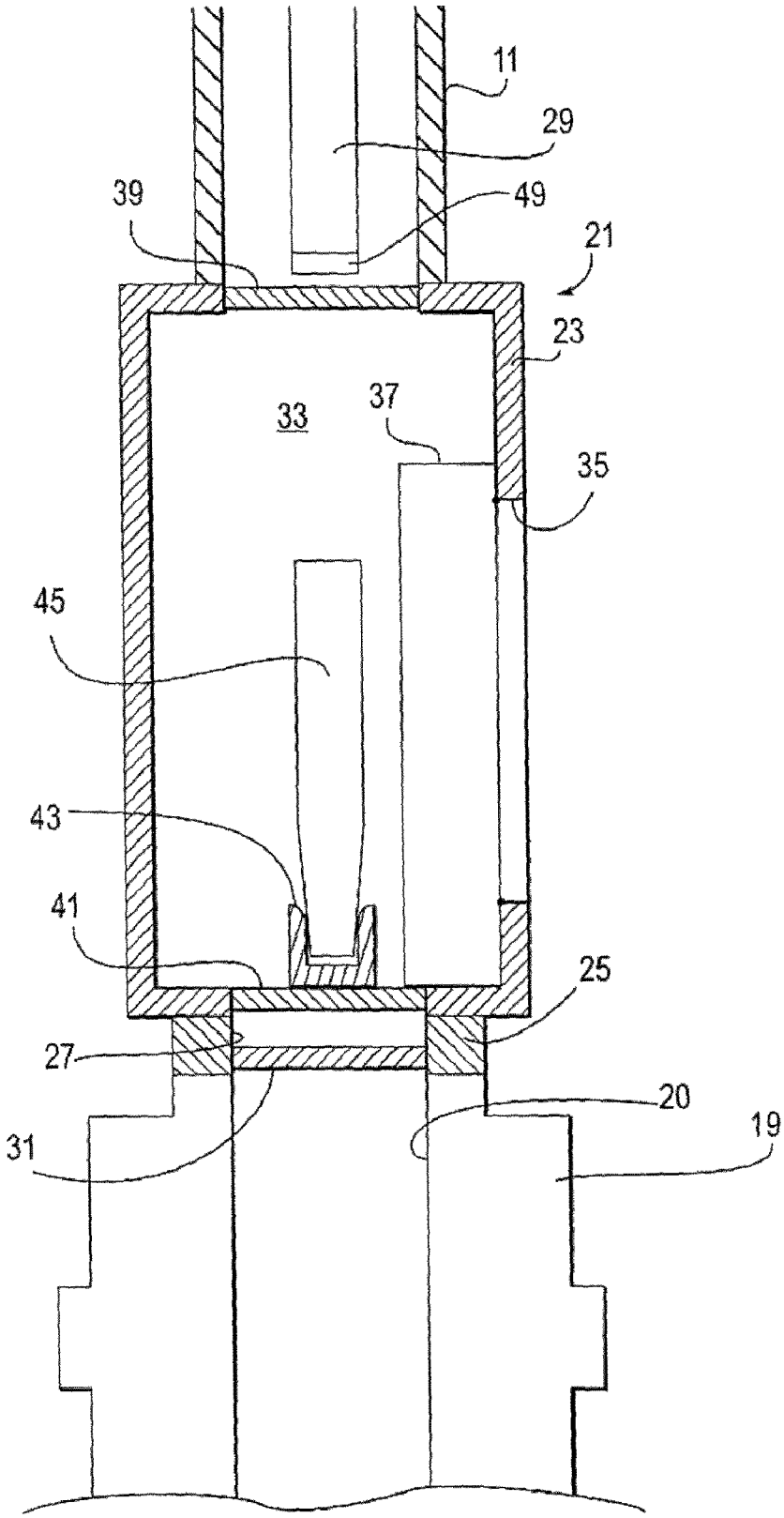
FIG. 3 is an enlarged schematic sectional view of the adapter FIG. 2 connecting the riser and subsea well, with the adapter being open to access from the sea.

Referring to FIGS. 2 and 3, adapter 21 preferably has an outer tubular housing 23. Housing 23 extends downward from riser 11 to a disconnect, isolation assembly 25. Isolation assembly 25 lands upon and connects to LMRP 19. In the preferred embodiment, isolation assembly 25 includes a conventional connector for connecting to an upper end portion of LMRP 19, such a connector can be an H4 connector. Isolation assembly 25 also preferably has a bore 27 that aligns with bores 20,15 of LMRP 19 and subsea well 13 and subsea tree 17 to allow a string of coiled tubing 29 to access subsea well 13 and subsea tree 17 through riser 11, adapter 21, and LMRP 19 for intervention and workover operations. A valve 31 is preferably positioned within isolation assembly 25 in order to sealingly close bore 27. With LMRP 19 and valve 31 closed, riser 11 and adapter 21 can be raised and lowered without sea water entering either subsea well 13 or riser 11. As will also be appreciated by those skilled in the art, an operator can also flush riser 11 and adapter 21 when valve 31 is closed.

In the embodiment shown in FIGS. 2 and 3, tubular housing 23 defines a chamber 33 therein. An opening 35 extends through tubular housing 23 for access into chamber 33. Opening 35 can be operably opened and closed with a remote operated vehicle (ROV) for access into chamber 33. Numerous methods can be utilized for opening and closing opening 35, for example a door 37 can be hydraulically actuated with the ROV along either the inner or outer surface of tubular housing 23. Door 37 preferably sealingly engages tubular housing 23 when in the closed position (FIG. 2), and allows access to chamber 33 through opening 35 when in the open position (FIG. 3).

In the embodiment shown in FIGS. 2 and 3, adapter 21 includes an upper valve 39 that sealingly closes access to the bore of riser 11, and therefore closes an upper end portion of adapter 21. Valve 31 can be used for closing the lower end portion of adapter 21. Alternatively, as shown in FIGS. 2 and 3, adapter 21 can also include a lower valve 41. Valves 39, 31, and 41 (when present) are preferably hydraulically actuated from either the surface vessel 12 or with the ROV. Valve 39, and either valve 31 or valve 41 (when present) act together to sealingly close chamber 33, which allows the operator to open and close opening 35 without sea water entering subsea well 13 or riser 11, and also preventing well fluids from freely exiting to the environment. The term "valve" is used herein to refer to any device for controlling a flow of fluid. For example, each of the valves discussed herein can be a gate valve, ball valve, shear valve, plug valve, piston valve, or the like.

Adapter 21 can also include a tool positioner 43 within chamber 33. Tool positioner 43 can be hydraulically actuated between a central holding position (FIG. 3) substantially inline with the bore of riser 11, and an operating position (FIG. 2) offset from the bore of riser 11 and bore 27 of isolation assembly 25. Alternatively, positioner 43 can surround bore 27 and be hydraulically actuated radially inward and outward between a central holding position and an operating position. Tool positioner 43 preferably holds a tool 45, which can be selected from a variety of downhole tools, that is carried by a downhole conveyance device, such as coiled tubing 29, into subsea well 13 for intervention and workover operations when tool 45 is not connected to coiled tubing 29. In this and other embodiments, other downhole conveyance devices, such as jointed pipe, wireline, composite wire, or the like, can be used instead of the coiled tubing 29. Additional tools 45 can be stored adjacent subsea well 13 for easy access with the ROV in a tool carrier 47 (FIG. 1). Alternatively, housing 23 can be large enough to carry additional tools 45 within chamber 33 for access by the ROV without obstructing inline communication between the bore of riser 11 and bore 27.

In operation, riser 11 and adapter 21 are lowered from the vessel 12 at the surface of the sea to land on LMRP 19. Opening 35 is preferably closed at this time. Valve 31 is preferably closed so that sea water does not enter riser 11 through bore 27 of isolation assembly 25. Isolation assembly 25 sealingly connects adapter 21 with the upper end portion of LMRP 19, at which time valve 31 and LMRP 19 can be opened. Coiled tubing 29 or another downhole conveyance device is lowered through riser 11 into chamber 33. Typically, coiled tubing 29 will have tool 45 required for initial operations already connected to a lower end portion of coiled tubing 29, typically with a tool connector 49.

After completing initial workover operations with tool 45, the operator retracts coiled tubing 29 until tool 45 is within chamber 33. The ROV then closes valve 31 or 41 (when present), and hydraulically actuates tool positioner 43 from the operating position to the central holding position. Tool connector 49 then releases tool 45 so that tool 45 is being supported by tool positioner 43. The operator then retracts coiled tubing 29 until its lowermost end is above valve 39. The ROV then actuates valve 39 so that riser 11 and subsea well 13 are sealed off from chamber 33.

The ROV then opens opening 35 for access into chamber 33. ROV can then remove previous used tool 45 and replace it with another tool 45 located in tool carrier 47. With another 45 now being supported by tool positioner 43, ROV can close opening 35, and chamber 33 can be flushed. The ROV then opens valve 39, and coiled tubing 29 is lowered into chamber 33 for tool connector 49 to engage and now support new tool 45. The ROV then actuates tool positioner 43 to the operating position and opens valve 31 or 41 (when present). The operator then lowers coiled tubing 29 and continues operations within subsea well 13 with the new tool 45. Additional tools and equipment, such as plugs, can be installed and retrieved within subsea well 13 with the ROV via opening 35, as necessary.

Upon completing intervention and workover operations, the ROV closes valve 31 and access to subsea well 13 is closed within LMRP 19. The connector associated with isolation assembly 25 is either actuated from the surface or with the ROV so that isolation assembly 25 is disconnected from the upper end of LMRP 19. The operator then retracts riser 11 and adapter 21 to the vessel.

Figure 4:
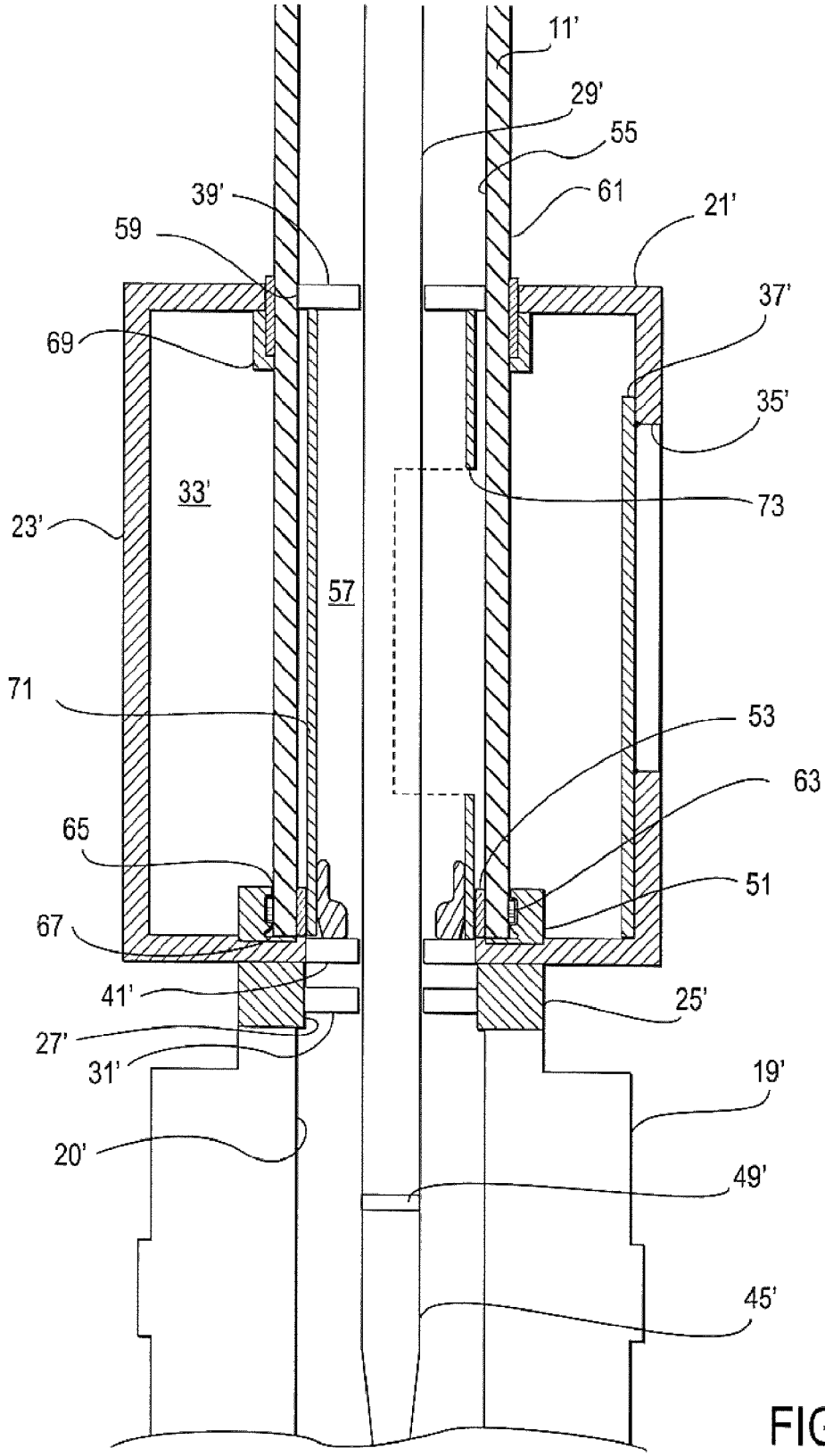
FIG. 4 is an enlarged schematic sectional view of an alternative embodiment of the adapter of FIG. 1 connecting the riser and subsea well, with the riser being in its lowered position and the adapter being sealed from the sea.
Figure 5:
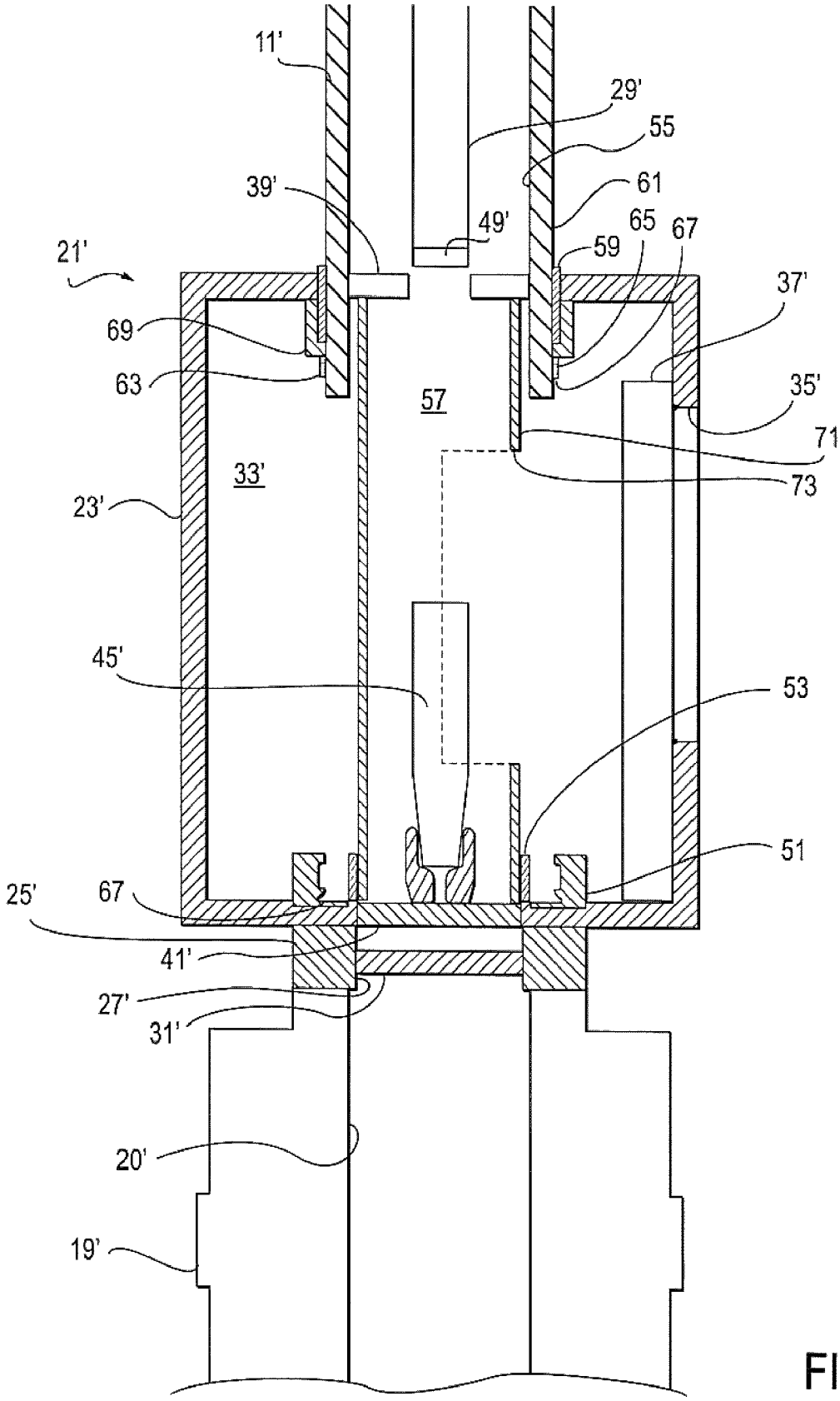
FIG. 5 is an enlarged schematic sectional view of the adapter FIG. 4 connecting the riser and subsea well, with the riser being in its raised position and the adapter being open to access from the sea.

Referring to FIGS. 4 and 5, an alternative embodiment is illustrated. In this embodiment, adapter 21' is connected to a lower end portion of riser 11'. As before, isolation assembly 25' connects adapter 21' to the upper end portion of LMRP 19'. In this embodiment, outer housing 23' is secured to isolation assembly 25', however riser 11' can operably move vertically relative to outer housing 23' when isolation assembly 25' is connected to LMRP 19'.

In the lowered position shown in FIG. 4, a locking assembly 51 that is positioned toward the lower end of outer housing 23'. Locking assembly 51 can be an integral part of outer housing 23' or part of isolation assembly 25'. Preferably, locking assembly 51 comprises either a collet connector or a plurality of locking dogs, which can be actuated into an unlocked position to allow riser 11' to move vertically upward from the lowered position shown in FIG. 4 to the raised position shown in FIG. 5. Locking assembly 51 is preferably a conventional collet or locking dog assembly that can be actuated remotely or locally, such as with an ROV, between locked and unlocked positions, as well as being mechanically self-actuating as riser 11' is lowered from the raised position (FIG. 5) to the lowered position (FIG. 4).

Seals 53 sealingly engage an interior surface 55 of riser 11' when riser 11' engages locking assembly 51 on the lowered position. Seals 51 and interior surface 55 of riser 11' thereby define an interior chamber 57 that is further sealed-off within chamber 33' inside of outer housing 23'. Preferably, seals 59 engage an outer surface 61 of riser 11' toward the upper end of outer housing 23' to sealingly define chamber 33' in this embodiment.

A profile 63 is preferably attached to outer surface 61 of riser at a predetermined location. Profile 63 preferably has upward and downward facing shoulders 65,67 for engagement by locking assembly 51 when in the lowered position, and engagement by stops 69 that act as a physical barrier to additional upward movement of riser 11' relative to outer housing 23' riser 11' reaches the raised position. An inner cage 71 is preferably positioned above isolation sleeve 25' within chamber 57. Inner cage 71 preferably has at least one opening 73 for access to tool 45' with the ROV. Opening 73 is selectively opened and closed by the raising and lowering of riser 11' as riser 11' moves between the lowered and raised positions shown in FIGS. 4 and 5.

Operation of the embodiment shown in FIGS. 4 and 5 is similar to the previous embodiment. Riser 11' and adapter 21' are lowered from the vessel 12 at the surface of the sea to land on LMRP 19'. Opening 35' is preferably closed at this time. Riser 11' is preferably in its lowered position relative to outer housing 23'. Locking assembly 51 is lockingly engaging shoulders 65,67 of profile 63. Interior surface 55 of riser 11' is preferably sealingly engaged by seals 53, and valve 31' is closed so that sea water does not enter riser 11'.

Isolation assembly 25' sealingly connects adapter 21' with the upper end portion of LMRP 19', at which time valve 31' and LMRP 19' can be opened. Coiled tubing 29' is lowered through riser 11' into chamber 57. Typically, coiled tubing 29' will have tool 45' required for initial operations already connected to a lower end portion of coiled tubing 29', typically with a tool connector 49'.

After completing initial workover operations with tool 45', the operator retracts coiled tubing 29' until tool 45' is within chamber 57. The ROV then closes valve 31' or 41' (when present), and hydraulically actuates tool positioner 43' from the operating position to the central holding position. Tool connector 49' then releases tool 45' so that tool 45' is being supported by tool positioner 43'. The operator then retracts coiled tubing 29' until its lowermost end is above valve 39'. The ROV then actuates valve 39' so that riser 11' and subsea well 13' are sealed off from chambers 57.

Locking assembly 51 is then unlocked remotely, either from the surface or with the ROV. The operator then retracts riser 11', thereby moving riser 11' from its lowered position shown in FIG. 4 toward its raised position shown in FIG. 5. Upward facing shoulder 65 of profile 63 engages stops 69 when riser 11' is in the raised position.

The ROV then opens opening 35 for access into chambers 33',57. ROV can then remove previous used tool 45' and replace it with another tool 45' located in tool carrier 47 (FIG. 1). With another 45' now being supported by tool positioner 43', ROV can close opening 35'. The operator then lowers riser 11' back to the lowered position with seals 53 engaging interior surface 55 of riser 11' and locking assembly self-actuating into engagement with profile 63. The ROV then opens valve 39', and coiled tubing 29' is lowered into chamber 57 for tool connector 49' to engage and now support new tool 45'. The ROV then actuates tool positioner 43' to the operating position and opens valve 31' or 41' (when present). The operator then lowers coiled tubing 29' and continues operations within subsea well 13' with the new tool 45'. Additional tools and equipment are installed and retrieved within subsea well 13' with the ROV via opening 35', as necessary.

Upon completing intervention and workover operations, the ROV closes valve 31' and access to subsea well 13' is closed within LMRP 19'. The connector associated with isolation assembly 25' is either actuated from the surface or with the ROV so that isolation assembly 25' is disconnected from the upper end of LMRP 19'. The operator then retracts riser 11' and adapter 21' to the vessel.

Adapters 21 and 21' of the present invention has several advantages for the operator. Adapters 21,21' can, for example, adapt/connect a 7⅝ inch casing to an H-4 connector, and contain pressure and handle well bore fluids. Adapters 21, 21' can also adapt/connect various diameters of casing to standard oilfield connectors, and contain pressure and handle well bore fluids. Adapters 21,21' can also have incorporated inside chamber 33,33' a location for "parking" or storing a downhole plug when installing new plugs or removing old ones from within the well. Adapters 21,21' also have upper and lower valves so that the cavity or chamber can be flushed and the adapter can be disconnected from the LMRP and brought to the surface. Adapters 21,21' can also have varying lengths so that a variety of downhole tools can be parked or stored and exchanged. Adapters 21,21' allow ROV access to the chamber so that the coiled tubing does not have to be run each time a tool is removed/installed. Adapters 21,21' have the capability of locking down with respect to subsea trees for intervention, as well as the capability of locking onto subsea pipelines for pipeline flow assurance issues and intervention.

While the invention has been shown in only some of its forms, it should be apparent to those skilled in the art that it is not so limited, but susceptible to various changes without departing from the scope of the invention. For example, riser 11 and adapter 21 can be connected to a pipeline end terminal for intervention/maintenance work on a subsea pipeline or for flow assurance issues.

What is claimed is:

1. A method for performing intervention and workover operations on a subsea well, comprising:

(a) providing a lower marine riser package connected to an upper portion of a subsea tree associated with a subsea well, and a conduit extending from a vessel toward the lower marine riser package;

(b) connecting the conduit to the lower marine riser package with an adapter;

(c) sealing a portion of a conduit bore of the conduit above the adapter from a chamber in the adapter;

(d) sealing a portion of a bore extending through the lower marine riser package from the chamber; and (e) opening the adapter for access to the chamber from the sea.

2. A system for performing intervention and workover operations on a subsea well, comprising:

a conduit extending from a vessel toward a subsea tree associated with a subsea well;

a lower marine riser package connected to an upper portion of the subsea tree, the lower marine riser package having a package bore in communication with a tree bore extending through the subsea tree and a well bore extending though the subsea well, the lower marine riser package selectively sealing the package bore;

an adapter connected to a lower end portion of the conduit and an upper portion of the lower marine riser package, such that the adapter is disposed between the conduit and the lower marine riser package and the conduit is connected to the lower marine riser package via the adapter, the adapter having a chamber and an opening through a sidewall that is selectively opened and closed from the sea;

an upper valve that selectively seals a portion of a conduit bore of the conduit above the adapter from the chamber; and a lower valve that selectively seals a portion of the package bore below the chamber.

3. An adapter for connecting a lower end portion of a conduit extending from a vessel with an upper portion of a lower marine riser package associated with a subsea tree, the adapter comprising:

a chamber and an opening through a sidewall that is selectively opened and closed from the sea;

an upper valve that selectively seals the chamber from a portion of a conduit bore of the conduit above the chamber; and a lower valve that selectively seals the chamber from a portion of the lower marine riser package bore below the chamber.

4. A method according to claim 1 wherein connecting the conduit to the lower marine riser package comprises connecting the conduit to the lower marine riser package via the adapter such that the adapter is disposed between the conduit and the lower marine riser package.

5. A method according to claim 1 wherein connecting the conduit to the lower marine riser package comprises connecting the adapter to an upper end portion of the lower marine riser package.

6. A method according to claim 1 wherein connecting the conduit to the lower marine riser package comprises connecting the adapter to an upper end portion of the lower marine riser package and connecting the adapter to a lower end portion of the conduit such that the adapter is disposed above the lower marine riser package and below the conduit.

7. A method according to claim 1 wherein sealing a portion of a conduit bore of the conduit above the adapter from a chamber in the adapter comprises closing a first valve between the conduit and the adapter and wherein sealing a portion of a bore extending through the lower marine riser package from the chamber comprises closing a second valve between the lower marine riser package and the adapter.

8. A system according to claim 2 wherein the adapter is connected to an upper end portion of the lower marine riser package.

9. A system according to claim 2 wherein the adapter is connected to an upper end portion of the lower marine riser package and connected to a lower end portion of the conduit such that the adapter is disposed above the lower marine riser package and below the conduit.

10. A system according to claim 2 wherein the upper valve is disposed between the conduit and the adapter and wherein the lower valve is disposed between the lower marine riser package and the adapter.

11. An adapter according to claim 3 wherein the adapter is configured to be disposed between the conduit and the lower marine riser package to connect the conduit to the lower marine riser package.

12. An adapter according to claim 3 wherein the adapter is configured to connect to an upper end portion of the lower marine riser package.

13. An adapter according to claim 3 wherein the adapter is configured to connect an upper end portion of the lower marine riser package and to a lower end portion of the conduit such that the adapter is disposed above the lower marine riser package and below the conduit.

14. An adapter according to claim 3 wherein the upper valve is configured to be disposed between the conduit and the chamber and the lower valve is configured to be disposed between the lower marine riser package and the chamber.

* * * * *